US005768859A

United States Patent [19]

Goglio

[11] Patent Number: 5,768,859

[45] Date of Patent: Jun. 23, 1998

[54] INSTALLATION FOR PACKAGING COFFEE

[76] Inventor: Luigi Goglio, Via Frua 11, 20146-Milano, Italy

[21] Appl. No.: 633,461

[22] Filed: Apr. 17, 1996

Related U.S. Application Data

[62] Division of Ser. No. 283,260, Aug. 1, 1994, Pat. No. 5,532,011.

[30] Foreign Application Priority Data

Aug. 11, 1993 [IT] Italy ..... MI93A1817

[51] Int. Cl.[6] ..... B65B 55/00

[52] U.S. Cl. ..... 53/510; 53/511; 53/111 R; 426/397; 426/410; 426/595

[58] Field of Search ..... 53/432, 428, 510, 53/111 R, 433, 511, 512; 426/410, 411, 413, 419, 397, 404, 392, 386, 316, 595

[56] References Cited

U.S. PATENT DOCUMENTS

| | | | |
|---|---|---|---|
| 1,367,726 | 2/1921 | Trigg . | |
| 1,426,011 | 8/1922 | Reynolds . | |
| 1,924,059 | 1/1933 | Hoskins . | |
| 1,992,556 | 2/1935 | Tone . | |
| 2,009,321 | 7/1935 | McKinnis . | |
| 2,046,158 | 6/1936 | Gore et al. . | |
| 2,335,192 | 11/1943 | Moore et al. . | |
| 3,021,218 | 2/1962 | Clinton et al. . | |
| 3,039,882 | 6/1962 | Clinton et al. . | |
| 3,148,070 | 9/1964 | Mishkin et al. . | |
| 3,482,373 | 12/1969 | Morris | 53/511 |
| 3,506,446 | 4/1970 | Champion . | |
| 3,745,024 | 7/1973 | Ford et al. . | |
| 3,769,032 | 10/1973 | Lubsen et al. . | |
| 3,789,888 | 2/1974 | James et al. | 53/433 |
| 3,877,197 | 4/1975 | Cayton et al. . | |
| 4,001,450 | 1/1977 | Ford et al. . | |
| 4,004,398 | 1/1977 | Larsson et al. | 426/410 |
| 4,007,291 | 2/1977 | Siedlecki et al. . | |
| 4,034,116 | 7/1977 | Hamell et al. . | |
| 4,069,349 | 1/1978 | Shaw | 420/395 |
| 4,078,356 | 3/1978 | Gallo et al. | 53/511 |
| 4,119,736 | 10/1978 | Howland et al. . | |
| 4,241,563 | 12/1980 | Muller et al. | 53/511 |
| 4,478,858 | 10/1984 | Baird et al. . | |
| 4,551,344 | 11/1985 | Jasovsky et al. . | |
| 4,556,575 | 12/1985 | Katz et al. . | |
| 4,653,326 | 3/1987 | Danel et al. . | |
| 5,059,036 | 10/1991 | Richison et al. . | |
| 5,361,500 | 11/1994 | Sandolo | 53/111 R |

FOREIGN PATENT DOCUMENTS

| | | | |
|---|---|---|---|
| 674626 | 4/1966 | Belgium . | |
| 553249 | 6/1958 | Canada . | |
| 575517 | 5/1959 | Canada . | |
| 1115890 | 4/1956 | France . | |
| 4-40853 | 2/1992 | Japan . | |
| 1263266 | 2/1972 | United Kingdom . | |
| 2085392 | 4/1982 | United Kingdom | 426/392 |
| WO93/19612 | 10/1993 | WIPO . | |

*Primary Examiner*—James F. Coan
*Assistant Examiner*—Gene L. Kim
*Attorney, Agent, or Firm*—Oblon, Spivak, McClelland, Maier & Neustadt, P.C.

[57] ABSTRACT

A process for packaging coffee, which includes a grinding phase of the coffee coming from silos, a forming phase for forming flexible or semi-rigid containers and a phase for filling such containers with the coffee and subsequent sealing of the pack, in which, during the container forming phase, the containers are preliminarily filled with gas and, at the same time, closed at their top, in such a way as to be able to be opened again immediately before filling. The filling takes place in an atmosphere controlled by a flow of gas, wherein the gas for preliminarily filling the containers and/or for controlling the atmosphere during the container filling phase is drawn from a coffee grinding plant. An installation for putting such process into effect is also proofed.

6 Claims, 4 Drawing Sheets

INSTALLATION FOR PACKAGING COFFEE

This is a Division of application Ser. No. 08/283,260 filed on Aug. 1, 1994 now U.S. Pat. No. 5,532,011.

BACKGROUND OF THE INVENTION

1. Field of the Invention

The present, invention refers to a process a related installation, by means of the use of gas and without carrying out any vacuum creating operation.

2. Discussion of the Background

Usually, when ground coffee is packaged in hermetic flexible containers, in order to keep the shape and to preserve the coffee, it is obligatory to carry out an operation to create a vacuum inside the container, so as to give it the necessary compactness and to allow the quantities of oxygen inside the pack to be kept low, which is an essential condition for ensuring proper preservation until the moment it is used.

This process is extremely complex and requires very expensive systems, since it needs the coffee to be partially or completely degassed beforehand and to be left for a certain length of time in suitable silos.

Said degassing can possibly be accelerated by washing with gas.

After this the coffee must be packaged in rather complicated and expensive systems, since it has to undergo the vacuum process.

Although this technique is rather expensive, it is very widespread, since it allows the coffee to be preserved well before it is used. However, once the pack is opened the quality of the product falls off very rapidly, since it absorbs the air outside and quickly tends to oxidize.

There have also been proposals for non-vacuum packaging coffee, but in the presence of gas of the product itself.

However, these techniques have proved to be unsatisfactory, since it is not guaranteed that the product will remain in a gas atmosphere, because it is usually introduced into the container in the presence of air.

SUMMARY OF THE INVENTION

The aim of the invention is to eliminate the above-mentioned drawbacks, by providing a process and relative installation for packaging coffee in a total gas atmosphere, thus ensuring excellent preservation of the product and the preservation of its qualities even after the pack has been opened for a considerable length of time.

This aim is achieved, with the process according to the invention, by foreseeing the steps of letting in of gas of the product itself into the container in its forming phase, such gas being conveniently recovered from the grinding plant, and by closing the pack temporarily, which is re-opened for being filled with the product, carried out to advantage in a gas atmosphere micro-chamber.

In particular, the container is realized on a hollow mandrel with a squaring and welding system at the bottom and a creasing and spot-welding system at the top. During the forming phase on the mandrel, the container is filled with gas through its cavity. In such a way, the container produced, when welded on the bottom part and spotwelded on the top part, is full of gas.

The upper part of the container in this way is temporarily closed and foresees the escape of the gas during the tranversing phase of the container to the filling plant, where it is opened by a suction system. Alternatively, welding can also be used on the top part of the container, to a thickness of 2–3 millimeters, in which case provision will be made for the upper edge to be cut immediately below such weld just before filling.

Filling takes place in a controlled atmosphere micro-chamber, by means of a screw, whose discharge pipe is inserted into the container, which has previously been opened.

The atmosphere is controlled by gas injected through special nozzles.

Still in the micro-chamber, the container is moved towards a plant for sealing the top part, which is then definitively sealed and folded.

When the product to be delivered in the time set by the cycle is insufficient, a second screw can be installed to split the quantity delivered.

The container has a volume greater than the maximum volume of the coffee, in such a way that it leaves headroom sufficient to render unnecessary any compensation of the volume of the container, which, on the other hand, is an operation required in the case of flexible vacuum containers.

The container is also provided with a degassing valve on the lid part, which allows the escape of the gas developed by the coffee.

This allows two advantages to be obtained, which are: firstly, avoidance of any overpressure which may develop inside; secondly, a further reduction in the excess quantity of oxygen inside the container, since when this is mixed with the gas generated by the product it escapes by the exhaust valve.

The gas used is drawn from the grinding plant of the coffee itself, thus avoiding the need to use subsequent purification systems, which are usually needed for eliminating the gases produced by the grinding plant.

When the product used is in bean form, instead of powder, the screws can be replaced with hermetic weighing machines and the product can be fed by means of a special dispenser, also hermetic, and connected with the coffee grinders by special proof channels.

BRIEF DESCRIPTION OF THE DRAWINGS

Further characteristics of the invention will be made clearer by the detailed description given below, which refers to one of its merely exemplary and therefore not restrictive embodiments, illustrated in the appended drawings, and in which.

Figure 1:
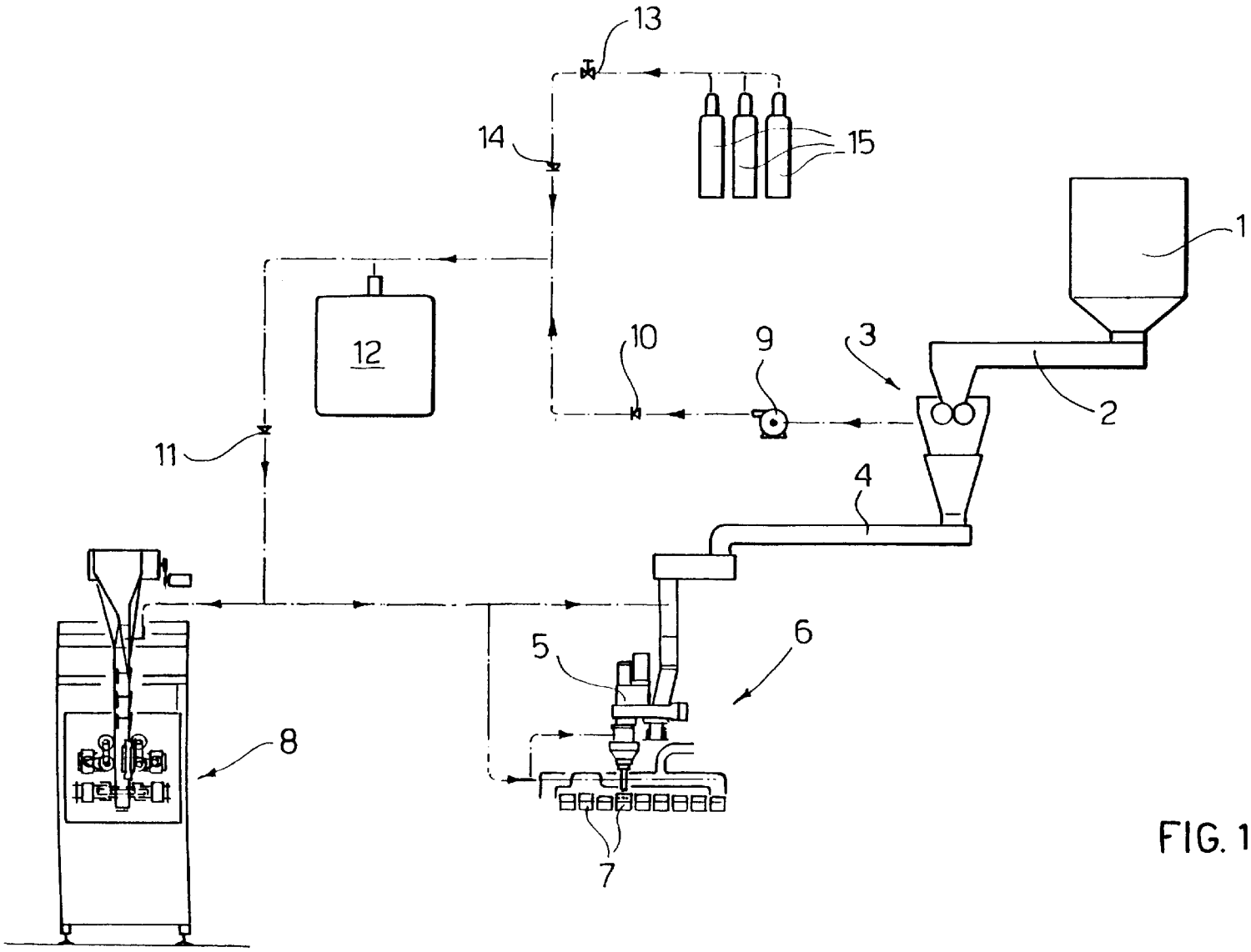
FIG. 1 is a schematic diagram, of the installation for packaging coffee in a gas atmosphere according to the invention.

With reference first to the diagram in FIG. 1, a silo, shown with reference numeral 1, contains coffee in bean form, which is fed by means of a duct 2 to a grinding plant 3, from which the coffee in powder form is sent by means of a feeder duct 4 and dispenser screws 5 to a packaging plant 6, in which containers 7, previously formed in a plant 8, are filled with the product and sealed.

In the forming plant 8, which will be described more clearly below with reference to FIGS. 2 and 3, the containers are previously filled with gas drawn from the grinding plant 3, by means of a suction ventilator 9, which sends it to such forming plant 8 through non-return valves 10, 11, passing through a storage and expansion chamber 12, consisting of flexible hermetic containers. The expansion chamber 12 is connected upstream, by means of a pressure-reducing valve 13 and a non-return valve 14, to an external gas source, stored in cylinders 15, such as nitrogen or $CO_2$, to compensate for any possible deficiencies in the system and to activate it in the starting phase.

The gas coming from the grinding station 3 is also sent to the packaging plant 6, which then works in a gas atmosphere, as will be described below in detail with reference to FIG. 4.

Figure 2:
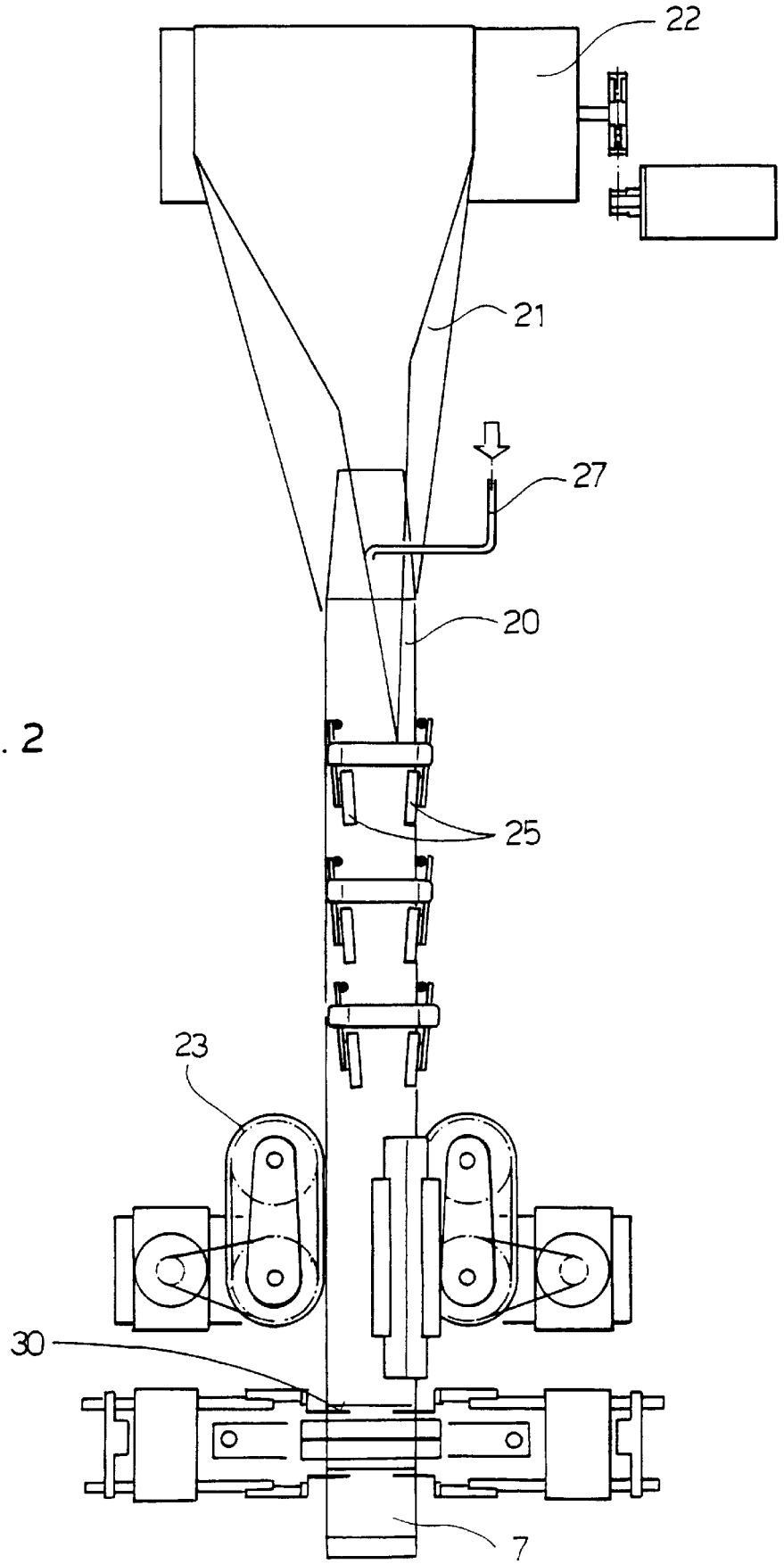
FIGS. 2 and 3 are a diagrammatic front view and a diagrammatic side view, respectively, of the hollow mandrel with a flow of gas for the formation of containers previously filled with gas.
Figure 3:
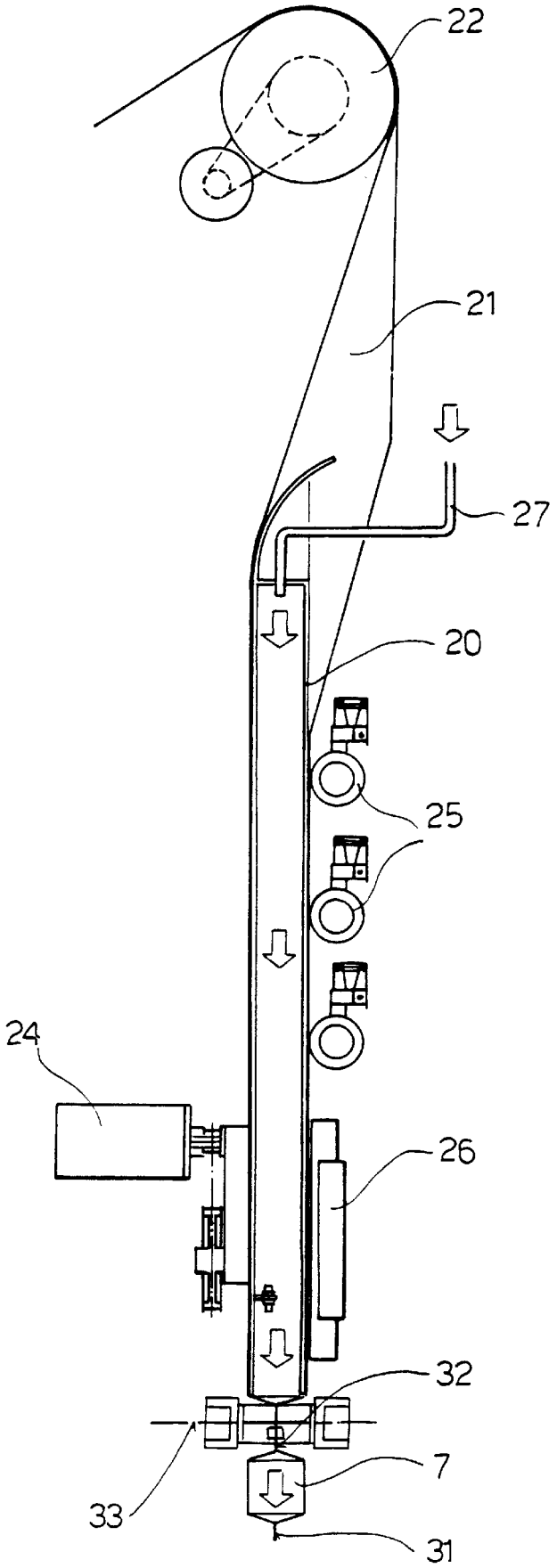

With special reference now to FIGS. 2 and 3, it will be noted how the containers 7 are realized on a hollow mandrel 20, starting from a sheet material 21 with one or more layers, which passes on an upper guider roller 22, winds around the mandrel 20 and is pulled downwards by draft wheels 23 driven by a motor 24.

The strip of sheet material 21 is closed around the mandrel 20 by means of rollers 25, thus forming a tubular form which is sealed longitudinally by a welding rod 26.

Such tubular form is open at the top part of the hollow mandrel, so as to allow the passage of an inflow pipe 27 for the gas drawn from the grinding station 3, as shown with reference to FIG. 1.

The container 7 is realized with a squaring system 30. The container undergoes a first transverse welding on the bottom 31 and, after gas is let into it through the tube 27, creasing and spot-welding at the top 32. This is followed by the cutting operation of the container by means of a cutting rod 33.

In such way, the container which is made, welded at the bottom and simply spot-welded at the top, is full of gas and is transported to the packaging plant 6.

Figure 4:
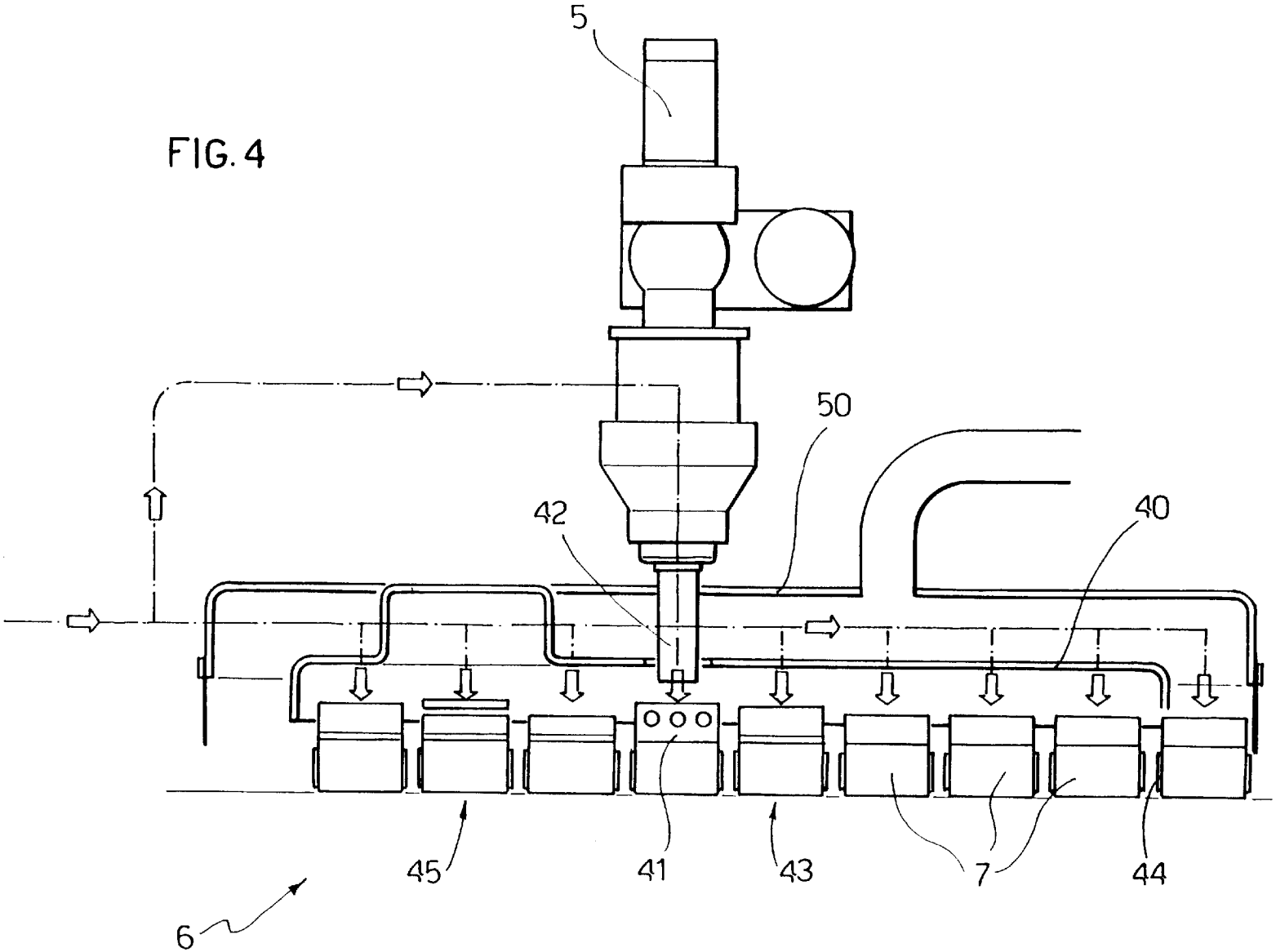
FIG. 4 is a diagrammatic view of the container filling and welding plant with a micro-chamber with a flow of gas.

Such plant, as can be seen more clearly in FIG. 4, comprises a micro-chamber 40 with atmosphere controlled with a flow of gas, inside of which the filling and re-welding of the container 7 take place.

In particular, a suction system 41 is foreseen for opening the upper part of the container, in such a way that the discharge pipe 42 of the dispenser screw 5 can be inserted into it.

The container 7 is then transferred to a sealing subplant 43, where the final re-welding on the upper part takes place, and then the container can be sent to be unloaded, drawn by special clamps 44. All the above operations take place in a controlled atmosphere, which ensures excellent product quality and preservation.

In FIG. 4, inside the micro-chamber 40, a trimming plant 45 is also used, serving to cut the upper edge of the gas-filled container, whenever the container has been welded in the forming plant 8, instead of being simply spot-welded.

The container 7 is sized so as to have a volume greater than the maximum volume of the coffee, and this leave sufficient headroom. The container is also provided with a degassing valve on its upper part which allows the gas generated by the coffee to escape.

Of course, filling the containers 7 with coffee in bean form can also be foreseen, and in this case the dispenser screw or screws 5 can be replaced by hermetic weighing machines, to which the product is fed by means of a special dispenser, also hermetic.

With the process and installation according to the invention, the coffee introduced into the hermetic container 7 is surrounded by its own aroma. Therefore, when the container 7 is opened for use, the coffee always proves to be of the highest quality, which is also maintained for a long time after opening.

I claim:

1. An installation for packaging coffee, which comprises:

a mechanism forming a gas filled container by forming a strip of sheet material comprising one or more layers around a mandrel so that the container is closed at the bottom and open at the top; a grinding station grinding coffee and in the process forming a coffee grinder gas said mechanism filling the container with a coffee grinder gas;

a closing device temporarily closing the top of the gas-filled container with an openable closure;

a mechanism opening the temporary closure and immediately introducing coffee in one of a ground form and a bean form into the gas-filled container; and a sealing device sealing the top of the container by welding and subsequent creasing wherein said opening mechanism, said introducing mechanism and said sealing device are operable in an atmosphere comprising coffee grinder gas with or without an additional inert gas such that the coffee is packaged surrounded by its own aroma and wherein said container is provided with headroom at a top portion of the container.

2. An installation according to claim 1, which comprises a degassing valve wherein said container is positionable at a top portion of said degassing valve.

3. An installation according to claim 1, wherein said mechanism introducing coffee into the container operates in an inert gas atmosphere.

4. An installation according to claim 1, wherein said closing device comprises a creasing and spot welding mechanism.

5. An installation according to claim 1, wherein said closing device comprises a suction system.

6. An installation for packaging coffee, which comprises:

a mechanism forming a gas filled container by forming a strip of sheet material comprising one or more layers around a mandrel so that the container is closed at the bottom and open at the top; a grinding station grinding coffee and in the process forming a coffee grinder gas said mechanism filling the container with a coffee grinder gas;

a mechanism introducing coffee in one of a ground form and a bean form into the container; and a sealing device sealing the top of the container by welding and subsequent creasing wherein said introducing mechanism and said sealing device are operable in an atmosphere comprising coffee grinder gas with or without an additional inert gas such that the coffee is packaged surrounded by its own aroma, said container being provided with headroom at a top portion of the container wherein said mechanism filling the container with coffee grinder gas is operable prior to introduction of the coffee in said one of said ground form and said bean form into the container.

* * * * *